US008977171B2

(12) United States Patent
Yokoyama et al.

(10) Patent No.: US 8,977,171 B2
(45) Date of Patent: Mar. 10, 2015

(54) IMAGE FORMING APPARATUS

(71) Applicant: Canon Kabushiki Kaisha, Tokyo (JP)

(72) Inventors: Ken Yokoyama, Suntou-gun (JP); Tsubasa Takeuchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/102,988

(22) Filed: Dec. 11, 2013

(65) Prior Publication Data

US 2014/0169840 A1 Jun. 19, 2014

(30) Foreign Application Priority Data

Dec. 17, 2012 (JP) ..... 2012-275003

(51) Int. Cl.
*G03G 15/01* (2006.01)
*G03G 15/08* (2006.01)
*G03G 15/16* (2006.01)

(52) U.S. Cl.
CPC ..... *G03G 15/1615* (2013.01); *G03G 15/0136* (2013.01); *G03G 2215/0193* (2013.01)
USPC ..... 399/302; 399/121; 399/298; 399/299

(58) Field of Classification Search
CPC ..... G03G 15/1615; G03G 15/0136; G03G 2215/0193
USPC ..... 399/121, 298, 299, 302
See application file for complete search history.

(56) References Cited

U.S. PATENT DOCUMENTS

| | | | | |
|---|---|---|---|---|
| 7,561,840 | B2 * | 7/2009 | Morimoto et al. | 399/299 |
| 8,103,182 | B2 | 1/2012 | Seki et al. | |
| 8,380,097 | B2 | 2/2013 | Seki et al. | |
| 2007/0071486 | A1 * | 3/2007 | Chiba et al. | 399/101 |

FOREIGN PATENT DOCUMENTS

| | | | |
|---|---|---|---|
| JP | 2003-186313 | A | 7/2003 |
| JP | 2005-115074 | A | 4/2005 |
| JP | 2010-102320 | A | 5/2010 |
| JP | 2013-44943 | A | 3/2013 |
| JP | 2013044943 | A * | 3/2013 |

* cited by examiner

*Primary Examiner* — David Gray
*Assistant Examiner* — Tyler Hardman
(74) *Attorney, Agent, or Firm* — Fitzpatrick, Cella, Harper & Scinto

(57) ABSTRACT

The image forming apparatus is capable of changing a state between a first state in which only a first image bearing member and transfer belt contact each other, and a second state in which respective image bearing members are separated from the transfer belt. A second transfer member is located at a first separating portion at which the second transfer member is separated from the image bearing member in the first state, and is located at a second separating position closer to the second image bearing member than the first separating position in the second state to regulate the position of the transfer belt.

20 Claims, 6 Drawing Sheets

COMPLETELY SEPARATING STATE

PARTIALLY CONTACTING STATE
IN MONO-COLOR MODE

COMPLETELY SEPARATING STATE

PARTIALLY CONTACTING STATE
IN MONO-COLOR MODE

COMPLETELY CONTACTING STATE

COMPLETELY SEPARATING CONDITION

IMAGE FORMING APPARATUS

BACKGROUND OF THE INVENTION

1. Field of the Invention

The present invention relates to an electrophotographic type image forming apparatus such as a copying machine or printer which can form a multi-color image.

2. Description of the Related Art

As an image forming apparatus such as a copying machine or page printer, an electrophotographic type image forming apparatus has been known conventionally. In the electrophotographic type image forming apparatus, the surface of a drum-like photosensitive member (to be referred to as a "photosensitive drum" hereinafter) serving as an image bearing member is uniformly charged and exposed by an exposure device based on image information, thereby forming an electrostatic latent image. A developing device develops the electrostatic latent image formed on the photosensitive drum as a toner image. The toner image is formed onto a transfer medium such as paper by using electrostatic force. Then, the toner image is fused and fixed onto the transfer medium by heat and pressure applied by a fixing device, and is discharged as an output image. Recent electrophotographic type image forming apparatuses are achieving advanced functions such as color printing and higher speed. Color image forming apparatuses for an electrophotographic process, which include an intermediate transfer belt for coping with these functions, have been widely employed.

As an example of electrophotographic type color image forming apparatuses, there is known an image forming apparatus which adopts an intermediate transfer belt as an intermediate transfer member. Toner images in yellow, magenta, cyan, and black (to be referred to as Y color, M color, C color, and Bk color hereinafter) are formed by a plurality of image forming stations and transferred to the intermediate transfer belt. These toner images are then transferred at once to a recording medium at a secondary transfer portion.

Japanese Patent Application Laid-Open No. 2010-102320 discloses an arrangement in which the primary transfer roller of each image forming station is moved to bring an intermediate transfer belt and each photosensitive drum into contact with each other or separate them from each other.

However, the intermediate transfer belt generates a flutter or ruffle to a certain degree during rotation. To reliably separate the intermediate transfer belt and primary transfer roller in consideration of these factors, a separation amount as large as possible is required. This sometimes hinders downsizing of the image forming apparatus. This problem arises not only in the intermediate transfer belt but also in an arrangement which adopts a conveyance belt for conveying a transfer medium.

SUMMARY OF THE INVENTION

The purpose of the present invention is to provide an image forming apparatus in which the separation distances between an image bearing member, an endless belt serving as an intermediate transfer belt or transfer medium conveyance belt, and a transfer member are satisfactorily ensured to reduce wear of the transfer member when the belt is driven.

Another purpose of the present invention is to provide an image forming apparatus including an endless transfer belt that is rotatable, a plurality of image bearing members that bear toner images, and a plurality of transfer members arranged at positions corresponding to the plurality of image bearing members through the transfer belt, wherein the plurality of transfer members transfers the toner images from the corresponding image bearing members to the transfer belt and is movable in a direction in which the plurality of transfer members contact the transfer belt during an image formation and is separated from the plurality of image bearing members during a non-image formation, wherein one of the plurality of transfer members is a regulating transfer member configured to regulate a position of the transfer belt by moving to a first separating position at which the regulating transfer member is separated from the corresponding image bearing member much more than during the image formation, and a second separating position located at a position closer to the image bearing member than the first separating position, and when the regulating transfer member is located at the second separating position, the corresponding image bearing member and the transfer belt are separated, the transfer belt and the regulating transfer member contact each other, and the remaining transfer members are separated from the transfer belt.

Another purpose of the present invention is to provide an image forming apparatus including an apparatus main body, an endless transfer belt that is rotatable, a first image bearing member that bears a toner image, a plurality of image bearing members including a second image bearing member configured to bear a toner image of a color different from a color of the first image bearing member, a first transfer member configured to be arranged at a position corresponding to the first image bearing member through the transfer belt and transfer a toner image from the first image bearing member to the transfer belt, and a plurality of transfer members configured to be arranged at positions corresponding to the plurality of image bearing members through the transfer belt and transfer toner images from the corresponding image bearing members to the transfer belt, wherein the apparatus main body is capable of changing a state between a partially-contacting state for mono-color print as the first state in which only the first image bearing member and the transfer belt contact each other, and an all-separating state as the second state in which the first image bearing member and the respective image bearing members are separated from the transfer belt, and a second transfer member arranged in correspondence with the second image bearing member among the plurality of transfer members is located at a first separating position at which the second transfer member is separated from the second image bearing member in the partially contacting state for mono-color print, and is located at a second separating position closer to the second image bearing member than the first separating position in the all-separating state to regulate a position of the transfer belt.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

An image forming apparatus according to the present invention will be described in detail below with reference to the accompanying drawings.

First Embodiment

Figure 1:
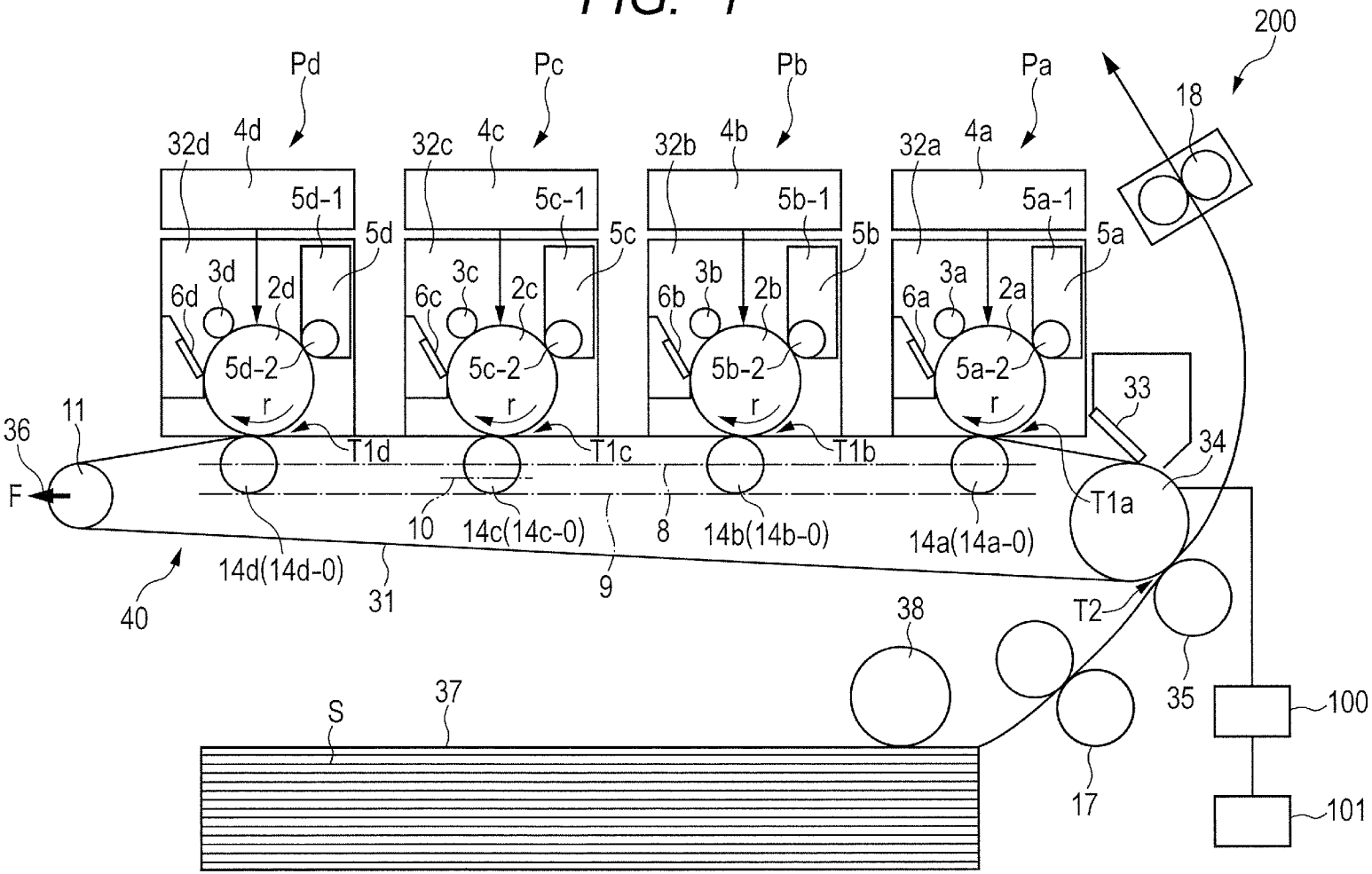
FIG. 1 is a sectional view of the schematic arrangement of a color image forming apparatus as an embodiment of an image forming apparatus according to the present invention.

FIG. 1 is a view showing the schematic arrangement of a color image forming apparatus 200 using an intermediate transfer method as an embodiment of the image forming apparatus according to the present invention. The color image forming apparatus 200 in the embodiment employs a tandem intermediate transfer method. More specifically, a plurality of image forming stations P (Pa, Pb, Pc, and Pd) including drum-like photosensitive members, i.e., photosensitive drums 2 (2*a*, 2*b*, 2*c*, and 2*d*) serving as first image bearing members form toner images of respective colors.

The color image forming apparatus 200 includes the yellow (Y color), magenta (M color), cyan (C color), and black (Bk color) image forming stations P (Pa, Pb, Pc, and Pd) arranged from the upstream side of image formation. Alphabetical letters a, b, c, and d are suffixed to the reference numerals or symbols of members forming the respective image forming stations P in the order of Y, M, C, and Bk colors to discriminate these members. When no alphabetical letter is added, the description is common to all of the image forming stations P.

Each image forming station P includes a process cartridge 32 and exposure unit 4. The Y color image forming station Pa, M color image forming station Pb, C color image forming station Pc, and Bk color image forming station Pd are disposed in the rotational direction of an intermediate transfer belt 31 serving as an endless transfer belt (to be described later).

The process cartridges 32 are four independent process cartridges 32 (32*a*, 32*b*, 32*c*, and 32*d*) for Y, M, C, and Bk each including the photosensitive drum 2 serving as an image bearing member, a charging roller 3, a developing unit 5, and a cleaning unit 6. The process cartridge 32 is detachable from the apparatus main body. Toner images of the different colors formed by the process cartridges 32 are sequentially superposed and transferred onto the intermediate transfer belt 31, and then secondarily transferred onto a transfer medium S at once, thereby obtaining a full-color image. The transfer medium S is fed from a paper feed cassette 37 and discharged onto a discharge tray (not shown).

Details of the color image forming apparatus 200 according to the embodiment will be explained. Since the internal arrangements and operations of the respective process cartridges 32 are almost the same, the operation of the Y color process cartridge 32*a* will be representatively explained.

The photosensitive drum 2*a* is a rotating drum type photosensitive member and is driven to rotate in a direction indicated by an arrow r at a predetermined peripheral velocity (process speed). The process speed of the image forming apparatus 200 in the embodiment changes depending on the type of the transfer medium S.

The primary charging roller 3*a* uniformly charges the photosensitive drum 2*a* serving as an image bearing member to a potential of a predetermined polarity (negative voltage in the embodiment). The photosensitive drum 2*a* is exposed by the exposure unit 4*a* constructed from a laser diode, polygon scanner, lens group, and the like, thereby forming an electrostatic latent image corresponding to the Y color component of the image signal.

After that, the developing unit 5*a* visualizes the electrostatic latent image formed on the photosensitive drum 2*a* by developing it into a toner image by using a Y color toner. The developing unit 5*a* includes a toner container 5*a*-1 which contains toner, and a developing roller 5*a*-2 which bears and conveys toner. The developing roller 5*a*-2 is made of a resistance-adjusted elastic rubber. The developing roller 5*a*-2 contacts the photosensitive drum 2*a* while rotating in the forward direction. By applying a voltage of a predetermined polarity (negative voltage in the embodiment) to the developing roller 5*a*-2, the toner which is borne on the developing roller 5*a*-2 while being friction-charged to the same polarity in each developing unit 5 is transferred to the electrostatic latent image on the photosensitive drum 2*a* to develop the image.

In the embodiment, the intermediate transfer member is the intermediate transfer belt 31 serving as a rotatable endless belt, as described above. The intermediate transfer belt 31 is driven to rotate in contact with the photosensitive drum 2*a* by the action of a driving roller 34 at almost the same peripheral velocity as that of the photosensitive drum 2*a*. A driving source 100 rotates the driving roller 34 and is controlled by a control unit 101 (controller). The intermediate transfer belt 31 is an endless film-like member having a volume resistivity of $10^8$ to $10^{12}$ Ω·cm and a thickness of 65 μm.

A primary transfer member 14*a* is arranged at a position where it faces the photosensitive drum 2*a* through the intermediate transfer belt 31. In the embodiment, the primary transfer member 14*a* is a primary transfer roller 14*a* which is a rotatable roller. The primary transfer roller 14*a* is rotated following the rotation of the intermediate transfer belt 31, and when it does not receive the rotation of the intermediate transfer belt 31, stops. Note that the primary transfer roller 14*a* is formed from a low-hardness material. More specifically, the primary transfer roller 14*a* is a resistance-adjusted sponge rubber roller having a hardness of 17° to 23° (Asker-C hardness) and a volume resistivity of $10^6$ to $10^7$ Ω·cm.

The photosensitive drum 2*a* and primary transfer roller 14*a* form a primary transfer nip (primary transfer portion) T1*a* through the intermediate transfer belt 31. When the toner image borne on the photosensitive drum 2*a* passes through the primary transfer portion T1*a*, it is transferred from the photosensitive drum 2*a* onto the intermediate transfer belt 31 by the action of static electricity generated by a positive voltage applied to the primary transfer roller 14*a*. The cleaning unit 6*a* removes and recovers the primary transfer residual toner remaining on the photosensitive drum 2*a* after transferring the toner image from the photosensitive drum 2*a* to the intermediate transfer belt 31.

The above-described process is performed similarly even in the process cartridges 32*b*, 32*c*, and 32*d* for C, M, and Bk colors, superposing a full-color toner image on the intermediate transfer belt 31. The full-color toner image superposed on the intermediate transfer belt is transferred to the transfer medium S by a secondary transfer roller 35 at a secondary transfer nip T2.

The image forming apparatus 200 according to the embodiment includes the secondary transfer roller 35 which is arranged on the outer surface side of the intermediate transfer belt 31 to face the driving roller 34 in contact with the inner surface of the intermediate transfer belt 31. The driving roller 34 and secondary transfer roller 35 form the secondary transfer nip T2 through the intermediate transfer belt 31. The resistance of the secondary transfer roller 35 is adjusted to a volume resistivity of $10^7$ to $10^9$ Ω·cm.

The transfer medium S picked up by a pickup roller 38 from the paper feed cassette 37 is synchronized and fed toward the secondary transfer nip T2 by a registration roller pair 17 which is driven to rotate at a predetermined timing. The full-color toner image formed on the intermediate transfer belt 31 is transferred onto the transfer medium S by the action of static electricity generated by a voltage applied to the secondary transfer roller 35. A fixing device 18 fixes the full-color toner image to the transfer medium S by heat and pressure, and then the transfer medium S is discharged from the apparatus (from the image forming apparatus main body). A belt cleaning device 33 serving as a cleaning means removes and recovers the secondary transfer residual toner remaining on the intermediate transfer belt 31 after transferring the toner image from the intermediate transfer belt 31 to the transfer medium S.

A tension roller 11 and the driving roller 34 are arranged on the inner surface side of the intermediate transfer belt 31. The tension roller 11 makes the intermediate transfer belt 31 keep applying a tension in a direction indicated by an arrow 36 at a tension force F of 10 kgf. The driving roller 34 is constituted by coating a metal cored bar with silicone rubber at a thickness of 100 μm.

The contact-separation arrangement of the primary transfer roller 14 as a feature of the present invention will be explained. The primary transfer roller 14 can move in a direction in which it comes into contact with the photosensitive drum 2 through the intermediate transfer belt 31 or is separated from the photosensitive drum 2. The movement of each primary transfer roller 14 is achieved by a driving unit. In the embodiment, two levels of the first separating portion and second separating portion (to be described later) are set as separating retraction portions of the primary transfer roller 14 in the image forming station P of at least one color. A transfer member having these two separating portions serves as a regulating transfer member. The regulating transfer member has a feature of taking the second separating portion in an all-contacting state as the third state and the first separating portion in a mono-color mode.

The general color image forming apparatus 200 can execute a full-color mode at the full-color image formation in which the plurality of image forming stations P function, and a mono-color mode at the mono-color image formation in which only one image forming station P functions. The color image forming apparatus 200 can select the mode because, if the photosensitive drum 2 of the image forming station P which does not function at the image formation in the mono-color mode keeps in contact with the intermediate transfer belt 31, the surface of the photosensitive drum 2 is worn owing to the contact with the intermediate transfer belt 31, shortening the lifetimes of the image forming station P and photosensitive drum 2. To solve this, an intermediate transfer unit which adjusts the contacting state between the intermediate transfer belt 31 and the photosensitive drum 2 in the image forming station P of the color image forming apparatus 200 takes three states: an all-separating state, mono-color mode, and full-color mode. Details of the intermediate transfer unit will be described later.

As described above, even the image forming apparatus according to the embodiment has three states.

(1) At the full-color image formation, the primary transfer rollers 14 serving as transfer members in the plurality of image forming stations P and the photosensitive drums 2 form the nips T1 through the intermediate transfer belt 31, forming the contacting state. At the full-color image formation, toner images are transferred from the photosensitive drums 2 of the plurality of image forming stations P to the intermediate transfer belt 31 to superpose color images onto the intermediate transfer belt 31. (All contacting state).

(2) At the mono-color image formation, only the photosensitive drum 2*d* of the achromatic image forming station Pd forms the nip T1*d* together with the primary transfer roller 14*d* through the intermediate transfer belt 31, forming the contacting state. At the mono-color image formation, a toner image is transferred from the photosensitive drum 2*d* to the intermediate transfer belt 31. (Partially Contacting State for Mono-Color Print).

(3) At the non-image formation, a separating state in which the photosensitive drums 2 of the plurality of image forming stations P and the intermediate transfer belt 31 do not contact each other is formed. (All-separating state).

By operating each primary transfer roller 14, the contacting state at the full-color image formation, the contacting state at the mono-color image formation, and the separating state at the non-image formation can be executed and switched.

First, the all-separating state and the mono-color mode will be explained in detail with reference to FIGS. 2A to 2C. In the embodiment, the primary transfer roller 14*c* of the C color image forming station Pc serving as the third image forming station has two separating portions, i.e., a first separating portion 14*c*-1 and second separating portion 14*c*-2. The primary transfer rollers 14*a*, 14*b*, and 14*d* of the remaining stations, i.e., the first, second, and fourth stations Pa, Pb, and Pd have the first separating portions 14*a*-1, 14*b*-1, and 14*d*-1.

The first separating portion is a retraction portion of the primary transfer roller 14 set so that the intermediate transfer belt 31 and photosensitive drum 2 are reliably separated and the primary transfer roller 14 and intermediate transfer belt 31 are reliably separated regardless of the flutter of the intermediate transfer belt during rotation. The second separating portion is a retraction portion of the primary transfer roller 14 set so that the intermediate transfer belt 31 and photosensitive drum 2 are reliably separated, and the primary transfer roller 14 raises the intermediate transfer belt 31 and is stably rotated following the rotation of the intermediate transfer belt 31.

The all-separating state of an intermediate transfer unit 40 will be explained first with reference to FIG. 2A.

The respective image forming stations Pa, Pb, Pc, and Pd will be called the first, second, third, and fourth stations sequentially.

Figure 2A:
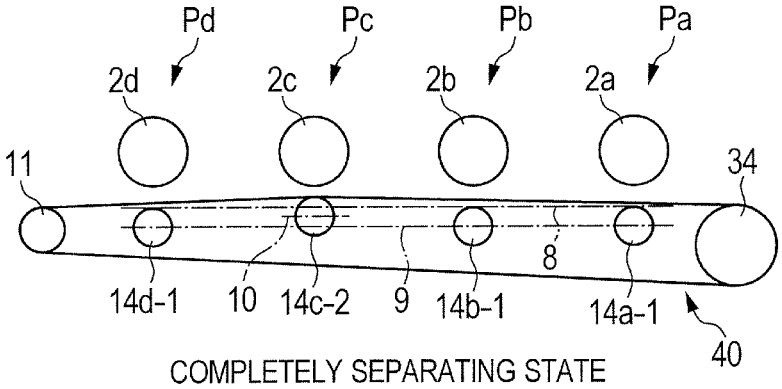
FIG. 2A is a sectional view of a schematic arrangement showing an all-separating state when transfer members and photosensitive drums are separated in a color image forming apparatus according to the first embodiment.
Figure 2B:
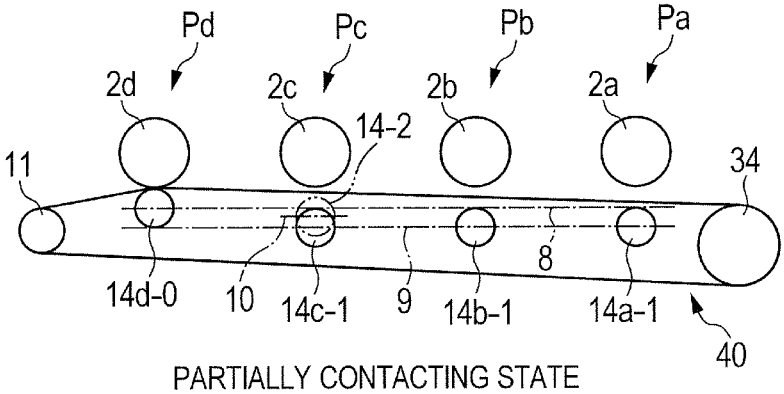
FIG. 2B is a sectional view of a schematic arrangement showing a partially contacting state for mono-color print when the transfer members and photosensitive drums are partially separated in the mono-color mode in the color image forming apparatus according to the first embodiment.

In the all-separating state at the non-image formation shown in FIG. 2A, the primary transfer rollers 14*a*, 14*b*, and 14*d* of the first, second, and fourth stations Pa, Pb, and Pd are moved to the first separating portions 14*a*-1, 14*b*-1, and 14*d*-1, and the primary transfer roller 14*c* of the third station Pc is moved to the second separating portion 14*c*-2.

The third station Pc sets the primary transfer roller 14*c* to the second separating portion 14*c*-2 by retracting the center of the rotating shaft of the primary transfer roller 14*c* to the position of the level 10, and implements separation between the photosensitive drum 2*c* and the intermediate transfer belt 31 while raising the intermediate transfer belt 31. The first, second, and fourth stations Pa, Pb, and Pd move the centers of the rotating shafts of the primary transfer rollers 14*a*, 14*b*, and 14*d* to the position of the level 9, and retract the primary transfer rollers 14*a*, 14*b*, and 14*d* of the first, second, and fourth stations Pa, Pb, and Pd to the first separating portions 14*a*-1, 14*b*-1, and 14*d*-1. The first, second, and fourth stations Pa, Pb, and Pd implement separation between the photosensitive drums 2 and the intermediate transfer belt 31 while reliably separating the primary transfer rollers 14*a*, 14*b*, and 14*d* and the intermediate transfer belt 31.

The separation amounts between the intermediate transfer belt 31 and the primary transfer rollers 14*a*, 14*b*, and 14*d* of the remaining stations Pa, Pb, and Pd can be ensured to be large by the distance by which the primary transfer roller 14*c* of the third station Pc raises the intermediate transfer belt 31.

Next, the mono-color mode at the mono-color image formation will be explained with reference to FIG. 2B.

According to the embodiment, in the mono-color mode, the intermediate transfer belt 31 contacts the photosensitive drum 2*d* for image formation in the fourth station Pd for Bk color (achromatic color), and is separated in the remaining color stations Pa, Pb, and Pc. That is, the center of the rotating shaft of the primary transfer roller 14*d* is moved to a level 8 at the contacting time, and the primary transfer roller 14*d* is located at a contacting portion 14*d*-0 (FIG. 2B). At this time, if the primary transfer roller 14*c* of the third station Pc remains at the level 10 in the all-separating state (i.e., the second separating portion 14*c*-2 shown in FIG. 2A), the clearance between the primary transfer roller 14*c* and the intermediate transfer belt 31 is small. To prevent the contact of the intermediate transfer belt 31 and primary transfer roller 14*c* owing to, e.g., the flutter of the belt upon driving the intermediate transfer belt 31, the center of the rotating shaft of the primary transfer roller 14*c* of the third station Pc that is located at the level 10 in the all-separating state is retracted to the level 9 (FIG. 2B). As for the third station Pc, the separating portion at the level 9 is a reliable separating portion from the intermediate transfer belt 31 in the mono-color mode, and serves as the first separating portion 14*c*-1.

Next, the contact-separation operation of the intermediate transfer belt 31 to and from the photosensitive drum 2 along with the image forming operation will be described with reference to FIGS. 1 and 2A to 2C. An image forming operation in the full-color mode will be explained first.

At the start of the image forming operation, the image forming apparatus is in the all-separating state of FIG. 2A. When the image forming operation starts, the intermediate transfer belt 31 and photosensitive drum 2 start rotating. The primary transfer roller 14*c* of the third station Pc is in contact with the intermediate transfer belt 31 and rotated following the rotation of the intermediate transfer belt 31. The contact linear pressure between the primary transfer roller 14*c* and the intermediate transfer belt 31 in the all-separating state is 3 gf/cm, which is satisfactory for rotation following the rotation of the intermediate transfer belt 31. Reliable following rotation suppresses wear.

After the intermediate transfer belt 31 and photosensitive drum 2*d* reach a predetermined peripheral velocity, the primary transfer roller 14*d* contacts the photosensitive drum 2*d* through the intermediate transfer belt 31, as shown in FIG. 1. The centers of the rotating shafts of the primary transfer rollers 14 move to the contacting portions at the level 8, and the primary transfer rollers 14 (14*a*, 14*b*, 14*c*, and 14*d*) of the respective image forming stations P (Pa, Pb, Pc, and Pd) achieve contact between the photosensitive drums 2 and the intermediate transfer belt 31. More specifically, the primary transfer rollers 14*a*, 14*b*, 14*c*, and 14*d* are arranged at the contacting portions 14*a*-0, 14*b*-0, 14*c*-0, and 14*d*-0. After the end of the image forming process, the rotating shafts of the primary transfer rollers 14*a*, 14*b*, and 14*d* of the first, second, and fourth stations Pa, Pb, and Pd move to the level 9, and the primary transfer rollers 14*a*, 14*b*, and 14*d* move to the first separating portions 14*a*-1, 14*b*-1, and 14*d*-1, as shown in FIG. 2A. Also, the rotating shaft of the primary transfer roller 14*c* of the third station Pc moves to the level 10, and the primary transfer roller 14*c* retracts to the second separating portion 14*c*-2. The photosensitive drums 2 and intermediate transfer belt 31 stop the rotation, ending the image forming operation.

Next, an image forming operation in the mono-color mode will be explained. In FIG. 2B, only the fourth station for Bk color contacts the intermediate transfer belt 31. Similar to the full-color mode, after the intermediate transfer belt 31 and photosensitive drum 2 reach a predetermined peripheral velocity, the primary transfer roller 14*d* contacts the photosensitive drum 2*d* through the intermediate transfer belt 31. That is, the primary transfer roller 14*d* is arranged at the contacting portion 14*d*-0. At the same time, the rotating shaft of the primary transfer roller 14*c* of the third station Pc is moved to the level 9, and the primary transfer roller 14*c* is retracted to the first separating portion 14*c*-1 to ensure a sufficient clearance from the intermediate transfer belt 31. In this manner, the primary transfer roller 14*c* is a regulating transfer member which can move between the first and second separating portions to regulate the belt position.

Figure 3A:
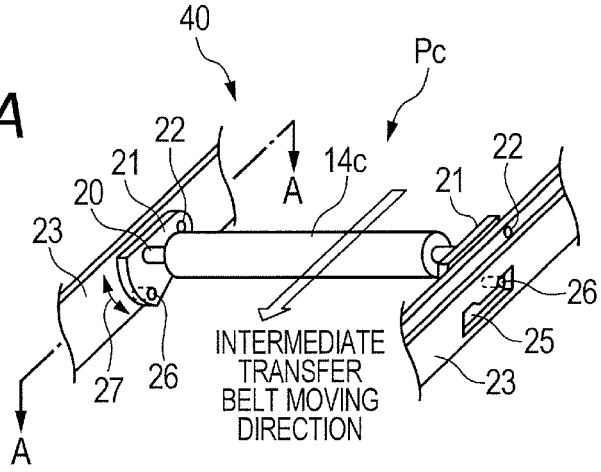
FIG. 3A is a schematic perspective view of the intermediate transfer unit which controls the contact-separation operation of a primary transfer roller, in order to explain the contact-separation operation of the primary transfer roller.
Figure 3B:
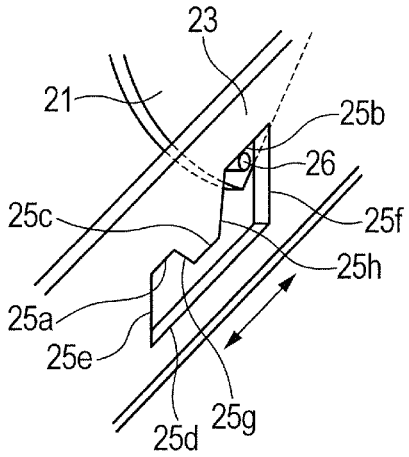
FIGS. 3B and 3C are schematic enlarged perspective views of a notch 25 in order to explain the contact-separation operation of the primary transfer roller.
Figure 3C:
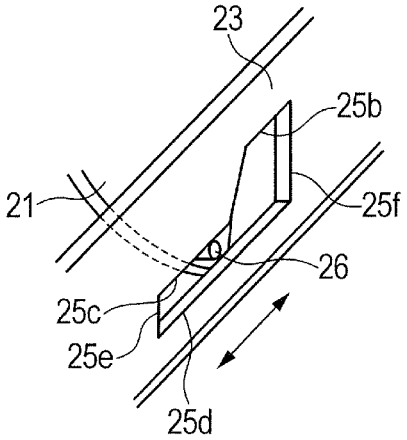
Figure 4A:
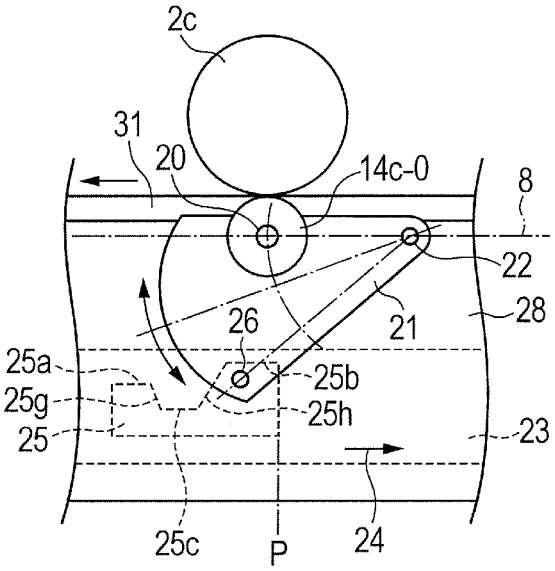
FIG. 4A is a schematic sectional view of the operation of the intermediate transfer unit when the photosensitive drum and primary transfer roller contact each other.
Figure 4B:
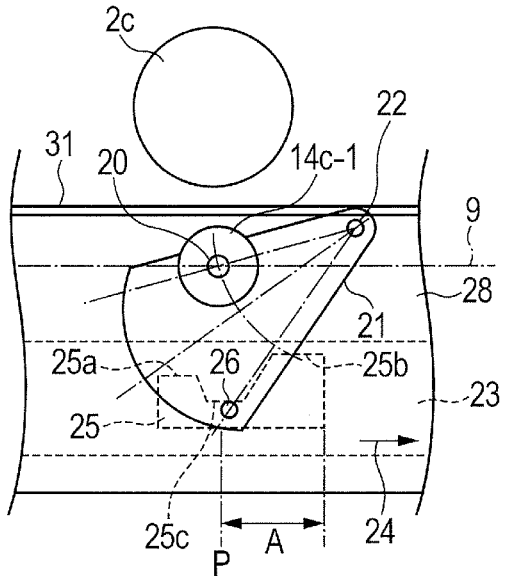
FIG. 4B is a schematic sectional view of the operation of the intermediate transfer unit when the primary transfer roller of the intermediate transfer unit is located at the first separating portion or position.
Figure 4C:
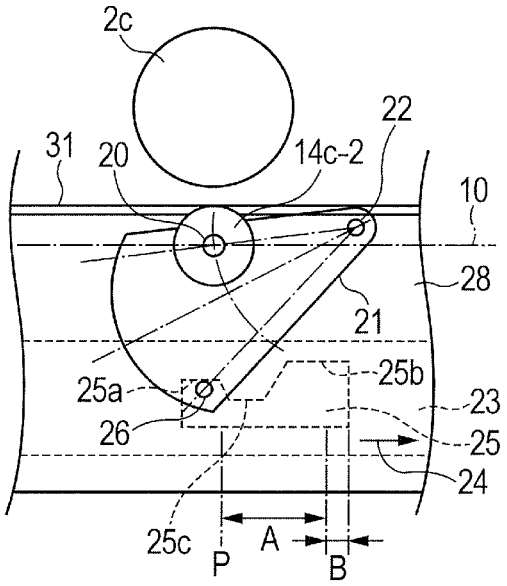
FIG. 4C is a schematic sectional view of the operation of the intermediate transfer unit when the primary transfer roller is located at the second separating portion or position.
Figure 4D:
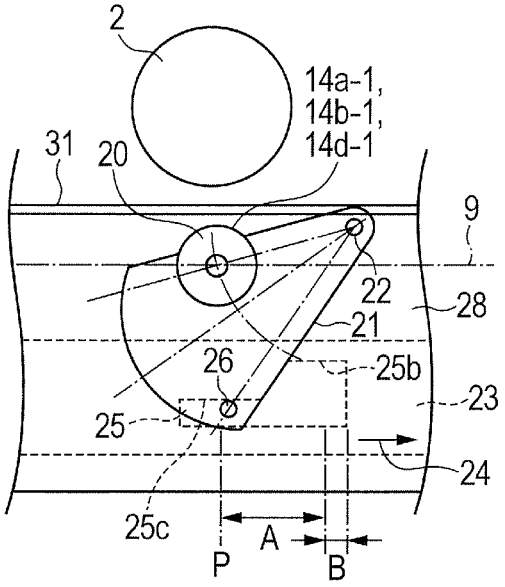
FIG. 4D is a schematic sectional view of the operation of the intermediate transfer unit when the primary transfer roller is not at the second separating portion or position.

A contact-separation mechanism in the intermediate transfer unit 40 of the primary transfer roller 14*c* of the third station Pc will be described in detail with reference to FIGS. 3A to 3C and 4A to 4D. FIG. 3A is a schematic perspective view of the primary transfer portion T1*c* of the third station Pc. FIG. 3B shows the notch of the sliding member of the third station Pc. FIG. 3C shows the notch of the sliding member of each of the first, second, and fourth stations Pa, Pb, and Pd. FIGS. 4A, 4B, and 4C are schematic side views of FIG. 3A and show the primary transfer roller 14*c* in the third station Pc at the contacting portion 14*c*-0, first separating portion 14*c*-1, and second separating portion 14*c*-2, respectively. FIG. 4D is a schematic side view showing the primary transfer rollers 14*a*, 14*b*, and 14*d* in the first, second, and fourth stations Pa, Pb, and Pd at the first separating portions 14*a*-1, 14*b*-1, and 14*d*-1.

Figure 2C:
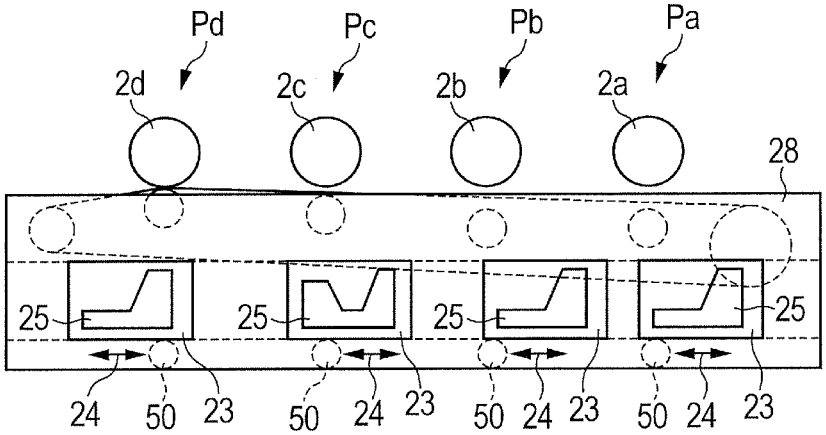
FIG. 2C is a sectional view of a schematic arrangement showing the position of the notch of an intermediate transfer unit in the partially contacting state for mono-color print.

Referring to FIGS. 2C and 3A, the intermediate transfer unit 40 includes the primary transfer rollers 14 (14*a*, 14*b*, 14*c*, and 14*d*), bearing members 21 which hold the primary transfer rollers 14 (14*a*, 14*b*, 14*c*, and 14*d*), respectively, sliding members 23 each having a notch 25, and intermediate transfer unit-side plates 28. As will be understood by referring to FIGS. 2C and 3A, the sliding members 23 are slidably borne by the intermediate transfer unit-side plates 28, and are driven in directions indicated by arrows 24 by driving means 50 controlled by the control unit 101 in accordance with the separating or contacting state of the primary transfer rollers 14. The notch 25 is formed in the sliding member 23. The sliding direction of the sliding member 23 is almost the same as the rotational direction of the intermediate transfer belt 31 at the primary transfer portion T1. The sliding member 23 slides in a predetermined range.

The third station Pc will be described with reference to FIGS. 3A, 3B, 4A, 4B, and 4C. A cored bar 20 of the primary transfer roller 14*c* is loosely inserted in each bearing member 21. The bearing member 21 is made of a highly slidable material and ensures rotation of the primary transfer roller 14*c*. The bearing member 21 is attached to the intermediate transfer unit-side plate 28 so that it can swing in directions indicated by an arrow 27 by using a rotating shaft 22 as the fulcrum. Further, press springs (not shown) are arranged on the bearing members 21 on the two sides to press the primary transfer roller 14*c* against the photosensitive drum 2*c* in the contacting direction. In other words, the primary transfer roller 14*c* can contact the photosensitive drum 2*c* by the spring force at a predetermined pressure.

The notch 25 of the third station Pc has a predetermined shape in the sliding direction. The base at the lower portion is a side 25*d* parallel in the sliding direction. The notch 25 has two sides 25*e* and 25*f* extending vertically from the base 25*d* on the two sides of the base 25*d* having a predetermined length. As shown in FIGS. 3A, 3B, and 3C, the notch 25 also has upper sides 25*a*, 25*b*, and 25*c* parallel to the sliding direction.

In the separation operation of the primary transfer roller 14*c*, the upper side 25*a*, 25*b*, or 25*c* of the notch 25 catches a boss 26 projecting from the bearing member 21 and controls upward movement of the boss 26. That is, upward movement of the boss 26 by the force of the spring used in the bearing member 21 is regulated to regulate the swing of the bearing member 21, that is, movement of the primary transfer roller 14 toward the photosensitive drum 2 and intermediate transfer belt 31. For example, in the embodiment, as shown in FIG. 4A, the level of the upper portion of the notch that contacts the boss 26 changes along with movement of the sliding member 23 in the right-and-left direction (directions indicated by the arrow 24). That is, the levels of the sides 25*a*, 25*b*, and 25*c* are different. The notch 25 has a shape capable of adjusting the primary transfer roller 14*c* to the first separating portion 14*c*-1, second separating portion 14*c*-2, or contacting portion 14*c*-0 (to be described later) in accordance with one of the sides 25*a*, 25*b*, and 25*c* of the notch 25 that contacts the boss 26.

More specifically, to set the primary transfer roller 14*c*, which is adjusted by the boss 26, to the portion 14*c*-0 (FIG. 4A) where the primary transfer roller 14*c* contacts the intermediate transfer belt 31 and photosensitive drum 2*c*, the boss 26 is prevented from contacting the upper side 25*b* of the notch. That is, the side 25*b* forms a notch of a level enough to move the boss satisfactorily upward. The press spring can sufficiently push up the bearing member 21. As a result, the intermediate transfer belt 31, photosensitive drum 2*c*, and primary transfer roller 14*c* contact each other.

To move the primary transfer roller 14*c* to the first separating portion 14*c*-1, the upper side 25*c* of the notch 25 is formed at a position lower than the upper side 25*b* by that much. Among the upper sides of the notch, the side 25*c* is located at the lowest level at which the boss 26 is lowered to locate the primary transfer roller 14*c* to the first separating portion 14*c*-1. The boss 26 is caught by the side 25*c* (FIG. 4B). In accordance with the position of the boss 26 caught by the side 25*c*, the swinging bearing member 21 moves down and as a result, the primary transfer roller 14*c* is lowered to the first separating portion 14*c*-1.

This also applies to the case of the second separating portion 14*c*-2. In movement to the second separating portion 14*c*-2, the boss 26 is caught by the side 25*a*. In accordance with the position of the boss 26 caught by the side 25*a*, the swinging bearing member 21 moves down and thus the primary transfer roller 14*c* is lowered to the second separating portion 14*c*-2 (FIG. 4C). Note that the side 25*a* is located above the side 25*c* and below the side 25*b*. Sides 25*g* and 25*h* of the notch that connect the upper sides of the notch are substantially inclined to smooth almost up-and-down movement of the boss 26 that is switched along with right-and-left movement of the sliding member 23.

Note that the notch need not always have the above-described shape, and the notch shape may be formed by a curve as long as the vertical position of the boss 26 can be adjusted by right-and-left movement of the sliding member 23 and the contact-separation distance of the primary transfer roller 14 can be further adjusted.

As described above, in FIG. 4A showing the contacting state of the primary transfer roller 14*c*, the primary transfer roller 14*c* contacts the photosensitive drum 2*c* through the intermediate transfer belt 31. The primary transfer roller 14*c* and photosensitive drum 2*c* receive the force of pressing the bearing member 21 by the press spring (not shown), and the primary transfer roller 14*c* contacts the photosensitive drum 2*c* at a desired set pressure. The boss 26 projecting from the bearing member 21 does not contact any side of the notch 25.

In FIG. 4B showing the separating state of the primary transfer roller 14*c* at the first separating portion 14*c*-1, the sliding member 23 moves by a distance A from a start point P of the notch 25 in the direction indicated by the arrow 24, and the boss 26 contacts the sliding member at the upper side 25*c* of the notch 25. Thus, the rotating shaft 20 of the primary transfer roller 14*c* is moved to the position of the level 9, and the primary transfer roller 14*c* is retracted to the first separating portion 14*c*-1. The intermediate transfer belt 31 is separated from the photosensitive drum 2*c*, and the primary transfer roller 14*c* does not contact the intermediate transfer belt 31.

In FIG. 4C showing the separating state of the primary transfer roller 14*c* at the second separating portion 14*c*-2, the sliding member 23 moves by a distance A+B from the start point P in the direction indicated by the arrow 24, and the boss 26 contacts the sliding member 23 at the upper side 25*a* of the notch 25. While raising the intermediate transfer belt 31, the primary transfer roller 14*c* is retracted to the second separating portion 14*c*-2 where it is separated from the photosensitive drum 2*c*.

FIG. 4D shows the first separating state of the primary transfer rollers 14*a*, 14*b*, and 14*d* in the first, second, and fourth stations Pa, Pb, and Pd. As shown in FIGS. 3C and 4D, only the side 25*c* is formed at the upper portion of the notch 25 to move the rotating shafts 20 of the primary transfer rollers 14*a*, 14*b*, and 14*d* to the level 9. Even when the sliding members 23 are moved in the direction indicated by the arrow 24, the primary transfer rollers 14*a*, 14*b*, and 14*d* take only two states, i.e., the first separating portion (14*a*-1, 14*b*-1, and 14*d*-1) shown in FIG. 4D and the contacting portion (14*a*-0, 14*b*-0, and 14*d*-0) shown in FIG. 1.

The contact-separation arrangement and operation in the embodiment have been described above.

Figure 6A:
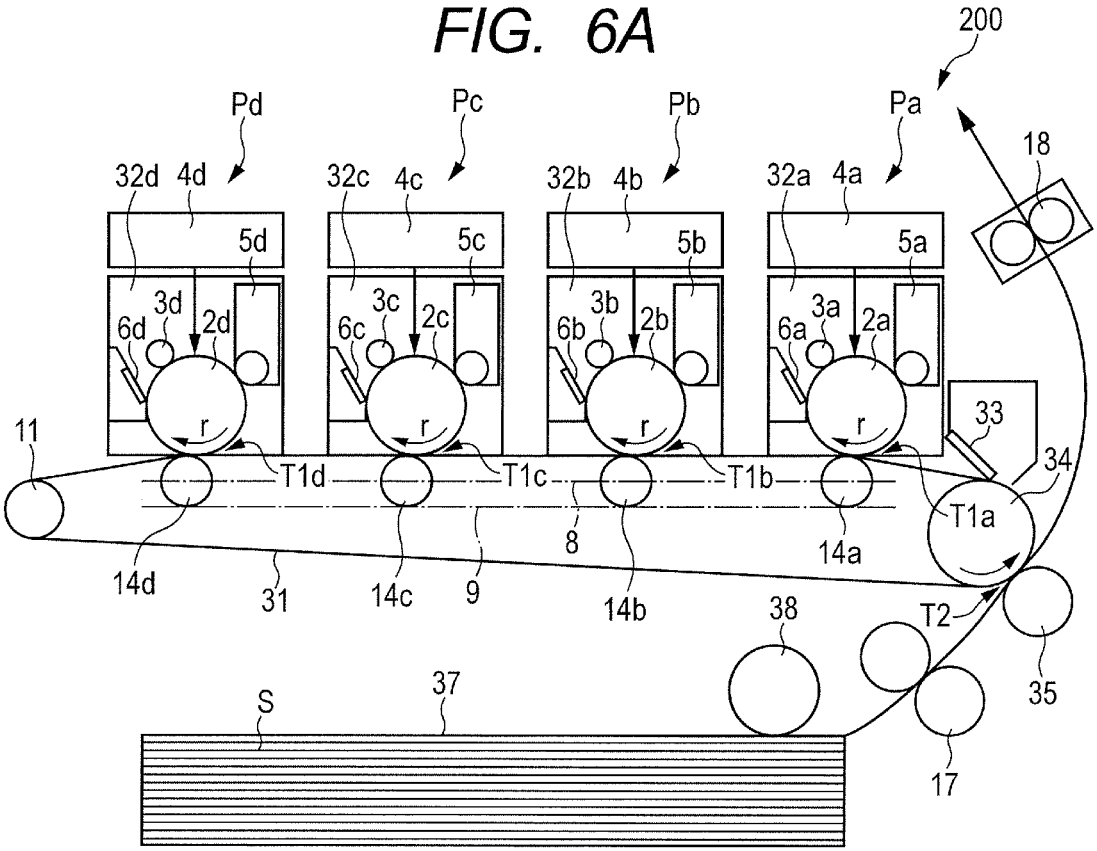
FIG. 6A is a sectional view of the schematic arrangement of a conventional color image forming apparatus.
Figure 6B:
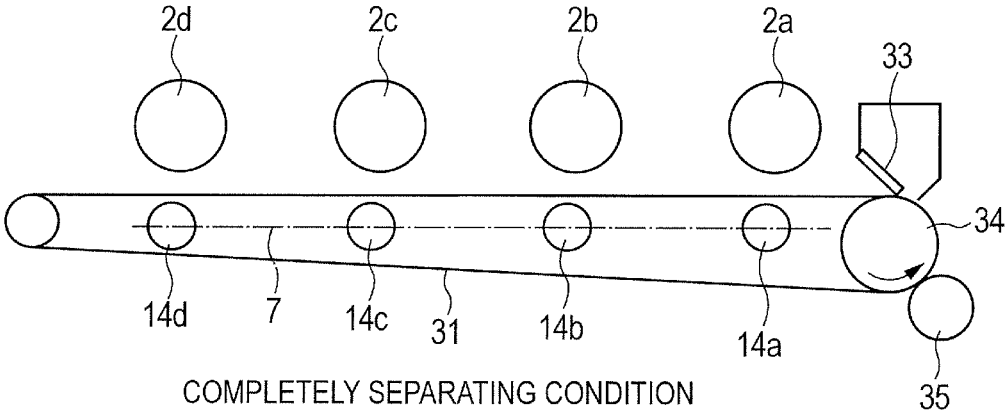
FIG. 6B is a sectional view of the schematic arrangement of the conventional color image forming apparatus showing separation at a conventional primary transfer portion.

Next, the effects of the embodiment will be explained using the above-mentioned related art shown in FIGS. 6A and 6B as a comparative example.

In a separating state according to the comparative example, a clearance of 0.5 mm is ensured to separate the intermediate transfer belt 31 and primary transfer roller 14 with respect to a surface (to be referred to as a tension-applied surface hereinafter) on which the driving roller 34 and tension roller 11 make the intermediate transfer belt 31 keep applying a tension. Also, in FIG. 2A showing the separating state according to the embodiment, the first separating portions 14*a*-1, 14*b*-1, and 14*d*-1 of the primary transfer rollers 14*a*, 14*b*, and 14*d* of the first, second, and fourth stations Pa, Pb, and Pd are set to be equal to the all-separating portion in the comparative example (ensure a clearance of 0.5 mm with respect to the tension-applied surface). As the arrangement unique to the embodiment, the primary transfer roller 14*c* of the third station Pc raises the intermediate transfer belt 31 by 2.5 mm from the tension-applied surface. Hence, the intermediate transfer belt 31 is raised by 0.8 mm, 1.7 mm, and 1.3 mm from the tension-applied surface at the respective positions of the first, second, and fourth stations Pa, Pb, and Pd. Table 1 below summarizes the clearances between the primary transfer roller 14 and the intermediate transfer belt 31 in the separating state in the embodiment and comparative example.

TABLE 1

| | First Station (Pa) | Second Station (Pb) | Third Station (Pc) | Fourth Station (Pd) |
|---|---|---|---|---|
| Embodiment | 1.3 mm | 2.2 mm | 0.0 mm (contact) | 1.8 mm |
| Comparative Example (Related Art) | 0.5 mm | 0.5 mm | 0.5 mm | 0.5 mm |

The surface position at which a tension is applied is defined by measuring the positions of the driving roller 34 and tension roller 11 by a three-dimensional measurement device while the intermediate transfer belt 31 is dismounted from the intermediate transfer unit 40. It also suffices to measure the positions of the primary transfer rollers 14 (14*a*, 14*b*, 14*c*, and 14*d*) similarly by the three-dimensional measurement device. This also applies to the primary transfer roller at the second separating portion, the driving roller 34, and the surface of the intermediate transfer belt at which a tension is applied by the primary transfer roller at the second separating portion and the tension roller 11. A plurality of portions of each of the primary transfer roller 14, driving roller 34, and tension roller 11 in the longitudinal direction are measured and averaged to calculate the positions of the surface at which a tension is applied and primary transfer roller 14. Table 1 represents the clearances between the primary transfer rollers 14 and the intermediate transfer belt 31 at the calculated separating portions.

In the embodiment, unlike the comparative example, the clearances between the intermediate transfer belt 31 and the primary transfer rollers 14*a*, 14*b*, and 14*d* in the stations Pa, Pb, and Pd except for the third station Pc can be increased to more reliably separate the intermediate transfer belt 31 and primary transfer rollers 14.

As described above, at least one color station, e.g., the third station Pc takes the two levels of the first separating portion 14*c*-1 and second separating portion 14*c*-2 for retraction portions of the primary transfer roller 14*c* as the separating state between the primary transfer roller and the photosensitive drum. By taking the second separating portion 14*c*-2 in the all-separating state and the first separating portion 14*c*-1 in the mono-color mode, the effects unique to the embodiment are obtained.

At the positions of the respective image forming stations P in the separating state, the clearances between the remaining primary transfer rollers 14*a*, 14*b*, and 14*d* and the intermediate transfer belt 31 can be ensured to be large by the distance by which the primary transfer roller 14*c* at the second separating portion 14*c*-2 raises the intermediate transfer belt 31. Since the intermediate transfer belt 31 is supported by the driving roller 34, the tension roller 11, and the primary transfer roller 14*c* located between them, the flutter of the intermediate transfer belt 31 in driving can be suppressed. Therefore, the primary transfer rollers 14*a*, 14*b*, and 14*d* and the intermediate transfer belt 31 can be reliably separated to suppress the wear of the primary transfer rollers 14 caused by the peripheral velocity difference.

In the embodiment, the second separating portion 14*c*-2 is set for the primary transfer roller 14*c* of the third station Pc, but the second separating portion may be set for another color station. In particular, when the second separating portion is set for an image forming station P located near the center, it becomes easier to raise the intermediate transfer belt 31 and ensure the clearance between the intermediate transfer belt 31 and the primary transfer rollers 14. The flutter of the intermediate transfer belt 31 can be further suppressed.

By the ensured clearance, the first separating portion can be set to be closer to the photosensitive drum 2. By setting the first separating portion to be closer to the photosensitive drum 2, the contact-separation stroke can be shortened. The movable space of each member can be reduced by the shortening of the contact-separation stroke, and the volume of the intermediate transfer unit 40 can be reduced, implementing downsizing of the main body and attendant reduction of the material cost.

Second Embodiment

The second embodiment has a feature in which the second separating portion is set for the separating portion of an achromatic station that functions in the mono-color image forming mode. This will be described in detail with reference to FIG. 5.

Figure 5:
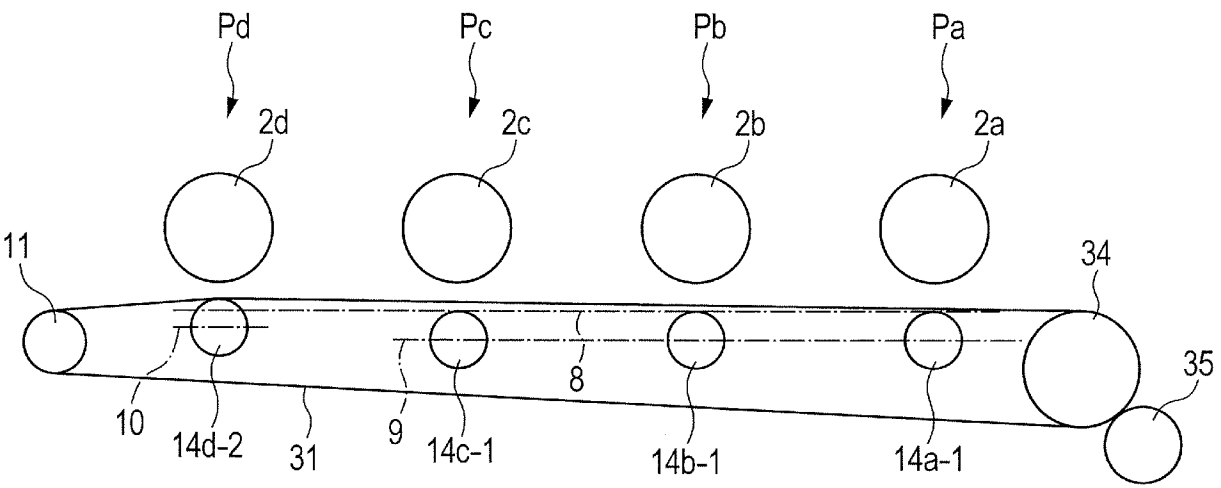
FIG. 5 is a schematic sectional view of a primary transfer portion showing a separating state according to the second embodiment of the present invention.

FIG. 5 shows a separating state according to the second embodiment. First, second, and third stations Pa, Pb, and Pc are chromatic stations, and a fourth station Pd is a Bk color (achromatic) image forming station. The first, second, and third stations Pa, Pb, and Pc retract to a level 9 of first separating portions 14*a*-1, 14*b*-1, and 14*c*-1. The fourth station Pd retracts to a level 10 of a second separating portion 14*d*-2. A primary transfer roller 14*d* of the fourth station Pd at the second separating portion (level 10) 14*d*-2 raises an intermediate transfer belt 31 by 2.5 mm. As a result, the intermediate transfer belt 31 is raised by 0.2 mm, 0.8 mm, and 1.9 mm from the surfaces at each of which a tension is applied at the respective positions of the first, second, and third stations Pa, Pb, and Pc. Unlike a comparative example, the second embodiment can effectively obtain clearances between the primary transfer rollers 14 and the intermediate transfer belt 31 in the separating state, as represented by Table 2 below. As the comparative example, the related art in FIGS. 6A and 6B were used similarly to the first embodiment.

TABLE 2

| | First Station (Pa) | Second Station (Pb) | Third Station (Pc) | Fourth Station (Pd) |
|---|---|---|---|---|
| Embodiment | 0.7 mm | 1.3 mm | 2.4 mm | 0.0 mm (contact) |
| Comparative Example (Related Art) | 0.5 mm | 0.5 mm | 0.5 mm | 0.5 mm |

In the full-color mode and mono-color mode, the primary transfer roller 14*d* of the fourth station Pd moves to a contacting level 8, i.e., a contacting portion 14*d*-0, and contacts a photosensitive drum 2*d* through the intermediate transfer belt 31. The fourth station Pd can form an image by setting only the two, second separating portion 14*d*-2 and contacting portion 14*d*-0 of the primary transfer roller 14*d*.

As an effect unique to the second embodiment, the second separating portion is set for a station which functions in the mono-color mode, so the two, first and second separating portions need not be set for one station, unlike the first embodiment. Since the two separating levels need not be set for a single station, the contact-separation arrangement can be simplified.

Although an image forming apparatus including an intermediate transfer belt has been exemplified as the arrangement of the image forming apparatus according to the present invention, the present invention is similarly applicable to an image forming apparatus including a transfer medium conveyance belt configured to convey a transfer medium. The arrangement of the image forming apparatus including the transfer medium conveyance belt is known to those skilled in the art, and a detailed description thereof will be omitted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-275003, filed Dec. 17, 2012, which is hereby incorporated by reference herein in its entirety.

What is claimed is:

1. An image forming apparatus comprising:

an endless transfer belt that is rotatable;

a plurality of image bearing members that bear toner images; and a plurality of transfer members arranged at positions corresponding to the plurality of image bearing members through the transfer belt, wherein the plurality of transfer members transfers the toner images from the corresponding image bearing members to the transfer belt and is movable so as to contact the transfer belt during image formation and is separated from the plurality of image bearing members during non-image formation, wherein one of the plurality of transfer members is a regulating transfer member configured to regulate a position of the transfer belt by moving to a first separating position at which the regulating transfer member is separated from the corresponding image bearing member much more than during the image formation, and a second separating position located at a position closer to the image bearing member than the first separating position, and when the regulating transfer member is located at the second separating position, the corresponding image bearing member and the transfer belt are separated, the transfer belt and the regulating transfer member contact each other, and the other transfer members are separated from the transfer belt.

2. An apparatus according to claim 1, wherein when the transfer belt is separated from the remaining transfer members, the regulating transfer member is located at the second separating position to increase distances between the remaining transfer members and the transfer belt.

3. An apparatus according to claim 1, wherein the regulating transfer member includes a rotatable roller, and when the regulating transfer member is located at the second separating position, is driven in contact with the transfer belt.

4. An apparatus according to claim 1, wherein in an all-separating state in which all the image bearing members and the transfer belt are separated, the regulating transfer member is located at the first separating position.

5. An apparatus according to claim 1, wherein the image bearing member corresponding to the regulating transfer member is configured to bear a chromatic toner image.

6. An apparatus according to claim 1, wherein one of the plurality of image bearing members is configured to bear an achromatic toner image, the apparatus main body is capable of executing a mono-color mode in which only the achromatic toner image is transferred to the transfer belt, and when executing the mono-color mode, the regulating transfer member is located at the first separating position.

7. An apparatus according to claim 1, wherein the transfer belt comprises an intermediate transfer belt configured to transfer a toner image from the image bearing members.

8. An apparatus according to claim 1, wherein the transfer belt comprises a recording medium conveyance belt configured to convey a recording medium to which a toner image is transferred from the image bearing members.

9. An image forming apparatus comprising:

an apparatus main body;

an endless transfer belt that is rotatable;

a first image bearing member that bears a toner image;

a plurality of image bearing members including a second image bearing member configured to bear a toner image of a color different from a color of the first image bearing member;

a first transfer member configured to be arranged at a position corresponding to the first image bearing member through the transfer belt and transfer a toner image from the first image bearing member to the transfer belt; and a plurality of transfer members configured to be arranged at positions corresponding to the plurality of image bearing members through the transfer belt and transfer toner images from the corresponding image bearing members to the transfer belt, wherein the apparatus main body is capable of changing a state between a first state in which only the first image bearing member and the transfer belt contact each other, and a second state in which the first image bearing member and the respective image bearing members are separated from the transfer belt, and a second transfer member arranged in correspondence with the second image bearing member among the plurality of transfer members is located at a first separating position at which the second transfer member is separated from the second image bearing member in the first state, and is located at a second separating position closer to the second image bearing member than the first separating position in the second state to regulate a position of the transfer belt.

10. An apparatus according to claim 9, wherein in a case where the second transfer member is positioned at the second separating position, the transfer belt separates from the second image bearing member and contacts the second transfer member.

11. An apparatus according to claim 9, wherein the second transfer member includes a rotatable roller, and when the second transfer member is located at the second separating position, is driven in contact with the transfer belt.

12. An apparatus according to claim 9, wherein the first image bearing member is located at a most downstream position in a rotational direction of the transfer belt.

13. An apparatus according to claim 12, wherein the second image bearing member is adjacent to the first image bearing member in the rotational direction of the transfer belt.

14. An apparatus according to claim 12, wherein the first image bearing member bears an achromatic toner image.

15. An apparatus according to claim 14, wherein the plurality of image bearing members are configured to bear toner images of different chromatic colors.

16. An apparatus according to claim 14, wherein the apparatus main body can switch a state between a third state in which all the first image bearing member and the plurality of image bearing members contact the transfer belt, the second state, and the first state.

17. An apparatus according to claim 9, further comprising a driving unit configured to drive the first transfer member and the plurality of transfer members with respect to the transfer belt, the driving unit including a sliding member, wherein the sliding member moves in a direction parallel to a rotational direction of the transfer belt to move the first transfer member and the plurality of transfer members.

18. An apparatus according to claim 9, wherein the transfer belt comprises an intermediate transfer belt configured to transfer a toner image from the image bearing members.

19. An apparatus according to claim 9, wherein the transfer belt comprises a recording medium conveyance belt configured to convey a recording medium to which a toner image is transferred from the image bearing members.

20. An apparatus according to claim 9, wherein when driving of the transfer belt starts, the apparatus main body is in the second state.

* * * * *